United States Patent [19]

Baum et al.

[11] Patent Number: 4,564,786

[45] Date of Patent: Jan. 14, 1986

[54] EXTERNAL NECK CHARGE DISSIPATION MEANS FOR AN IN-LINE COLOR CATHODE RAY TUBE

[75] Inventors: Steven A. Baum, Seneca Falls; Anthony V. Gallaro, Auburn; Frederick A. Hovey, Geneva; Charles H. Rehkopf; William J. Sember, both of Seneca Falls, all of N.Y.

[73] Assignee: North American Philips Consumer Electronics Corp., New York, N.Y.

[21] Appl. No.: 591,079

[22] Filed: Mar. 19, 1984

[51] Int. Cl.[4] ..... H01J 29/88

[52] U.S. Cl. ..... 313/479; 313/313

[58] Field of Search ..... 313/477 HC, 479, 313; 220/2.3 A

[56] References Cited

U.S. PATENT DOCUMENTS 3,746,904 7/1973 Torre ..... 313/479

4,503,357 3/1985 Ouhata et al. ..... 313/313 X

FOREIGN PATENT DOCUMENTS 0145045 8/1983 Japan ..... 313/479

*Primary Examiner*—Robert Yoncoskie

*Attorney, Agent, or Firm*—John C. Fox

[57] ABSTRACT

The invention provides efficient means for dissipating deleterious charge build-up in the glass neck portion of a color cathode ray tube employing an in-line plural beam electron gun assembly. In one embodiment, the invention is comprised of two longitudinal stripes of electrical conductive material oppositely applied on the neck substantially over both narrow sides of the gun assembly. Connective conductors join the stripes to the grounded funnel coating to provide for dissipation of the charge. In another embodiment, the longitudinal stripes are joined by two band-like layers encompassing inter-electrode spacings of the gun assembly.

6 Claims, 5 Drawing Figures

EXTERNAL NECK CHARGE DISSIPATION MEANS FOR AN IN-LINE COLOR CATHODE RAY TUBE

BACKGROUND OF THE INVENTION

1. Field of the Invention

This invention relates to in-line color cathode ray tubes, and more particularly to conductive means disposed on discrete external areas of the tube's glass envelope to dissipate the deleterious charge build-up occurring in the neck portion during tube operation.

2. Background Art

Color cathode ray tubes (CCRTs) conventionally utilized in color television and related pictorial and data display applications employ a screen of red, blue and green cathodoluminescent phosphor elements disposed on the interior surface of the viewing panel portion of an encompassing glass envelope. The envelope comprises an integration of the face panel portion with funnel and neck portions. An electron gun assembly, positioned in the neck portion, directs three in-line electron beams toward the screen, one for each phosphor color. A multi-opening mask member or aperture mask, positioned within the panel and spaced from the screen, permits the electron beams to strike the appropriate elements on the screen, whereupon the elements are excited to luminesce in one of the primary red, blue or green colors.

The gun assembly, encompassed within the neck portion, is constructed of three in-line cathodes to emit three in-line electron beams and a plurality of spatially-related electrodes positioned forward of the cathodes, each having three in-line apertures, to form, focus and accelerate the electron beams. In such in-line gun assemblies, the electrode members are necessarily markedly wider in the direction of the in-line plane than normal to the in-line plane, in order to accommodate the three in-line apertures. As a result, the two side apertures, as well as the surrounding electrode material defining such apertures, are much closer to the interior wall of the tube neck than the central aperture and its surrounding electrode material.

Such in-line gun assemblies have almost totally replaced the older delta gun arrangements in which three separate guns were arranged in a delta configuration.

On the exterior surface of the tube envelope, an electrically conductive coating is disposed on the forward area of the funnel portion. This coating is normally at ground potential when the tube is in operation. Spaced rearward from this funnel coating is a deflection yoke oriented to surround the envelope at substantially the transition area between the funnel and neck portions. Magnetic fields produced by the yoke provide for deflection of the electron beams to effect scanning of the screen raster.

While the glass of the neck portion is normally considered to be electrically neutral, when the tube is put into operation, it has been found that a deleterious charge build-up can occur on the external surface of the neck wall, which can be as high as about 16 KV in magnitude, or higher. Such a charge can induce fields which have a detrimental influence on the trajectories of the side aperture-related electron beams. This influence is evidenced, for example, by a spreading or mis-convergence of the side-related beams resulting in a haze-like appearance of the display image in the peripheral area of the screen and general mis-convergence.

When such spreading occurs gradually, over time, it is known as convergence drift.

Although neck charging has been known to occur for some time, recent advances in CRT technology have caused its effects to increase in both magnitude and importance. The desire for improved screen images has led to more stringent requirements for beam convergence, which is related to both resolution and color purity. For example, in certain high resolution tubes, mis-convergence errors as little as one-fourth the width of a phosphor element are considered undesirable. However, the trend toward smaller (mini) necks and yokes to save both materials and deflection power has led to smaller gun assemblies and diminished clearances, magnifying the effects of neck charging.

In addition, the introduction of the internal magnetic ring (IMR) into the mini-neck tube may also enhance neck charging. The IMR is located in the top or convergence cup of the electron gun and sets up magnetic fields which, during tube operation, correct certain mis-convergence problems which would otherwise occur as a result of the tube-to-tube variations inherent in any mass production process. Each IMR is "custom-magnetized" to correct its tube's particular mis-convergence, using an apparatus which closely surrounds the tube neck. Although the apparatus is thought to act as a ground when in place, subsequent rapid neck charging has been observed to occur when the apparatus is removed.

Attempts to reduce the neck charge by the use of grounded internal conductive neck coatings, although in some degree successful, have in general not been satisfactory due to the close proximity of various high potential elements such as gun electrodes and the internal conductive funnel coating, which promotes undesired arcing.

In U.S. Pat. No. 3,746,904 an external circumferential band of grounded conductive coating was applied to the neck of a delta tube over the focusing lenses of the electron gun assembly to evenly distribute the neck charge and prevent convergence drift.

However, it has been found that the known prior art techniques do not adequately resolve the annoying convergence drift problem resulting from neck charge build-up in state-of-the-art tubes incorporating plural beam in-line gun assemblies, particularly tubes having small neck configurations (e.g., mini-neck), and in tubes having internal magnetic rings (IMR).

SUMMARY OF THE INVENTION

It is accordingly an object of the invention to provide means for dissipating the neck charge build-up inherent in color cathode ray tubes. It is a further object of the invention to provide means for dissipating such neck charge build-up in in-line color cathode ray tubes, especially tubes with small neck configurations and internal magnetic rings.

It is a further object of the invention to provide means for dissipating neck charge build-up without promoting deleterious arcing from high voltage elements in the tubes.

In accordance with the invention, neck charge dissipation is achieved by providing external gun-related electrically conductive means in the form of at least one conductive stripe oriented longitudinally along the neck over the narrow side of the electron gun structure, and preferably by providing a pair of such conductive stripes oriented in opposing relationship on the neck. The conductive stripes are electrically connected to the grounded funnel coating by conductive strips which pass under the tube's yoke, and are thus preferably of higher resistivity than the funnel coating to guard against shorting of the yoke.

Additional charge dissipation means are preferably provided in the form of a first conductive band-like layer surrounding the neck substantially over the inter-electrode spacing between the final focusing and accelerating electrodes of the gun structure, and integral with the stripe. A second conductive band-like layer integral with the stripe and surrounding the neck substantially over the inter-electrode spacing between the beam-forming and initial accelerating electrodes, provides additional charge dissipation means.

In a most preferred embodiment, the external gun-related conductive means includes two longitudinal conductive stripes oppositely disposed on the neck substantially over the entire narrow side of the electron gun structure, the stripes being of a width at least equal to the narrow side dimension of the several electrodes comprising the gun assembly.

The longitudinal stripes preferably extend along substantially the full length and width of the gun assembly so that substantially all of the inter-electrode spacings are covered along the vulnerable side regions that are closely adjacent to the neck wall. The longitudinal stripes are each joined to the funnel coating by at least one intermediate connective strip, preferably of electrical resistance greater than that of the funnel coating.

Further in accordance with the preferred embodiment, the longitudinal stripes are joined to each other by a first pair of opposed arc-like strips of conductive material to form a first substantially peripheral band-like layer of conductive material over substantially the inter-electrode spacing between the final focusing and accelerating electrodes of the gun assembly. Further rearward, the stripes are again joined to each other by a second pair of opposed arc-like strips of conductive material to form a second substantially peripheral band-like layer of conductive material, over substantially the inter-electrode spacing between the beam forming and initial accelerating electrodes of the gun assembly.

In a unitized bi-potential in-line gun assembly including an initial beam forming electrode (G1), an initial beam accelerator electrode (G2), a main focusing electrode (G3) having a longitudinal dimension defined by forward and rearward apertured ends, and a final accelerator electrode (G4), the first external band-like conductive layer is positioned substantially over the forward (G3)-(G4) inter-electrode spacing, and the related second external band-like conductive layer is located substantially over the rearward (G3)-(G2) inter-electrode spacing.

In a unitized tri-potential in-line gun assembly including an initial beam forming electrode (G1), an initial beam accelerator electrode (G2), a first high focusing electrode (G3), a low focusing electrode (G4), a second high focusing electrode (G5), and a final accelerator electrode (G6), (each of the unitized (G3), (G4) and (G5) electrodes having longitudinal dimensions defined by forward and rearward apertured ends), the first band-like conductive layer is placed substantially over the forward (G4)-rearward (G5) and the forward (G5)-(G6) inter-electrode spacings, and the second band-like conductive layer is positioned substantially over the (G2)-rearward (G3) and the forward (G3)-rearward (G4) inter-electrode spacings.

By such external conductive means, the deleterious neck charge is efficiently dissipated or bled off from the most vulnerable regions of the gun assembly. As a result, the trajectories of the side-related beams are substantially unaffected by the distortive charge influences which lead to convergence drift. In addition, such discrete positioning of the conductive layers leaves clear areas of neck glass to enable visual inspection of the gun assembly and/or to facilitate accurate placement of external gun-related components, when such are required.

DESCRIPTION OF THE PREFERRED EMBODIMENTS

Figure 1:
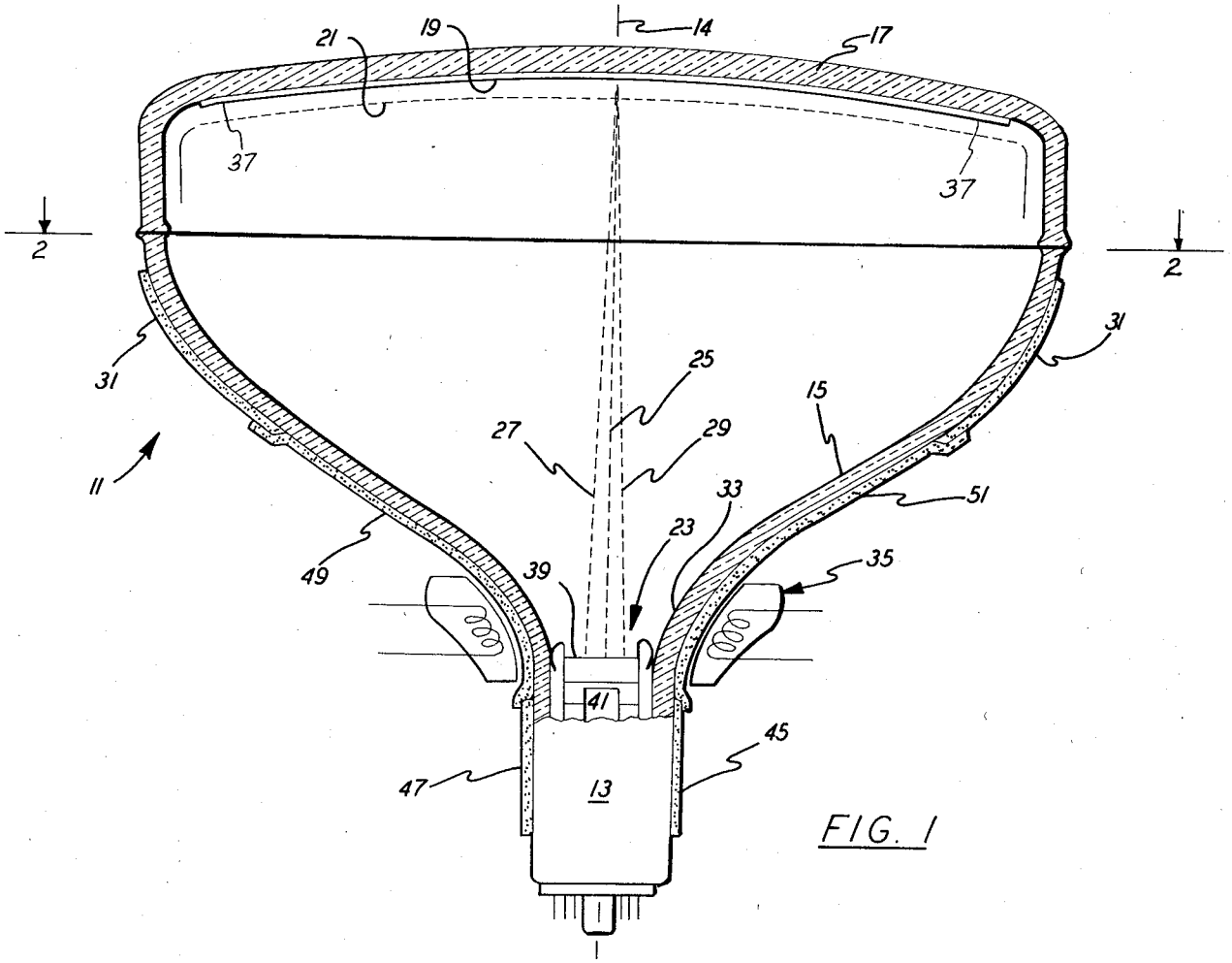
FIG. 1 is a sectional view of a color cathode ray tube employing the invention.

With reference to the drawings, FIG. 1 is a sectioned view showing the essential elements of a plural beam in-line color CRT 11 employing the invention. CRT 11 is oriented to have a central longitudinal axis 14 and X and Y axes normal to axis 14. The encompassing tube envelope is a glass structure comprised of a hermetically sealed integration of neck 13, funnel 15 and viewing panel 17 portions. Disposed on the interior surface of the viewing panel is a patterned cathodoluminescent screen 19 of stripes or dots of color-emitting phosphor materials. A multi-opening structure 21, in this instance an aperture mask, is positioned within the viewing panel in spaced relationship to the patterned screen 19. Encompassed within the neck portion 13 of the envelope is a unitized plural-beam in-line electron gun assembly 23, from which emanate three electron beams, a center beam 25 and two side beams 27 and 29 in a common in-line plane. These beams are directed and focused to traverse the aperture mask 21 and converge at screen 19 to excite the color-emitting phosphors.

The exterior surface of the tube has an electrically conductive coating 31, applied to the forward region of the funnel 15, and maintained at ground potential during tube usage. Rearward of this coated funnel area is the transition region 33 of the funnel and neck portions, at which is located deflection yoke 35. Yoke 35 is formed of critically wound and oriented coils to provide the necessary magnetic fields for deflection of the electron beams to produce desired scanning of the screen raster.

During operation of the tube, a charge build-up accumulates on the glass neck 13 of the tube. Since the charged glass surrounds the in-line gun assembly, fields induced by the charge enter the gun assembly through the inter-electrode spacings and disruptively alter the desired trajectories of the side aperture-related beams 27 and 29 as they proceed through the gun assembly, resulting in what are commonly referred to as beam convergence drift and image haze, the latter particularly evident in the peripheral area 37 of the screen 19.

Figure 2:
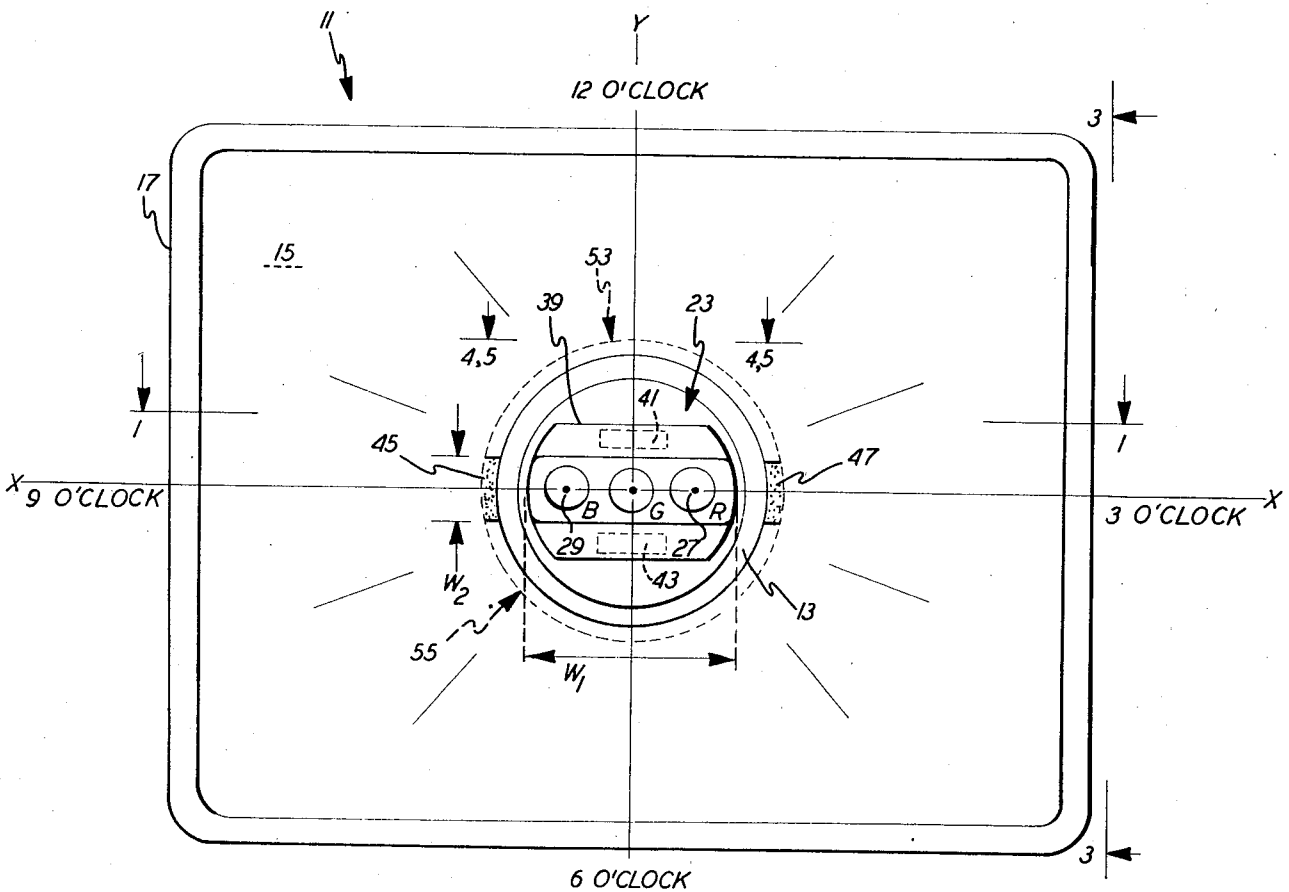
FIG. 2 is a frontal view of the tube taken along the plane 2—2 of FIG. 1.

The plural gun assembly 23 is positioned within the neck portion 13 in a manner whereby the three in-line beams 27, 25, and 29 are in a common horizontal "in-line" plane substantially coincident with the X axis of the tube. The gun assembly is a longitudinal construction of a plurality of spatially-related unitized in-line apertured electrode members having major $W_1$ and minor $W_2$ width dimensions, as shown in FIG. 2. The electrodes are positioned in a spaced, sequential arrangement forward of individual electron emitting cathode elements to form, focus and accelerate each of the individual electron beams. The assembly is forwardly terminated by a convergence cup 39, and the whole structure is integrated by at least two insulative multiform members 41 and 43. As shown in FIG. 2, the side aperture-related beams 27 and 29 are adjacent to the wall of neck 13. Thus, these beams, particularly in the space between electrodes, are vulnerable to the distortive influences exerted by the fields induced by the neck charge on the glass adjacent to the gun assembly.

It is the purpose of this invention to eliminate this distortion by disposing gun-related electrically conductive means on discrete areas of the exterior surface of the neck portion 13. These means preferably extend from a region rearward of the yoke positioning site 33 to the region of the cathode elements in the gun assembly, and are joined by intermediate electrical connective means to the funnel conductive coating 31 to provide an efficient means for dissipating neck charge from the gun-related area of the neck.

More explicitly and in accordance with one embodiment of the invention, the external gun-related electrical conductive means are in the form of two longitudinal stripes 45 and 47 of conductive material disposed in substantially opposed orientation on either side of the exterior surface of neck 13. These stripes are substantially parallel with the central axis 14, and lie in the in-line plane. The width of each stripe is preferably at least approximately equal to the average minor width dimension $W_2$ of the several electrodes of the gun assembly 23, so as to cover the inter-electrode spacings on each side of the gun assembly, and, when connected to grounded funnel coating 31 by connective means 49 and 51, dissipate the neck charge from the covered region.

The funnel coating typically exhibits a relatively low linear resistance, on the order of about 10 ohms per cm, and is typically of a composition known as aquadag, a colloidal suspension of graphite particles (soft dag) or iron oxide and graphite particles (hard dag) in an alkali silicate binder. The resistance of the gun-related conductive means is not critical, but must be less than that of the neck glass to permit charge dissipation. Since the intermediate connective means 49 and 51 traverse the yoke area, they preferably exhibit a relatively high electrical resistance, such as from about $10^6$ up to $10^{10}$ ohms per centimeter, to avoid shorting of the yoke, while insuring sufficient charge dissipation. The conventional dag compositions may be used for the gun-related means, while the connective means may be formed, for example, from a suspension of high resistance ferrite particles in a fugitive binder such as polyvinyl alcohol.

Figure 4:
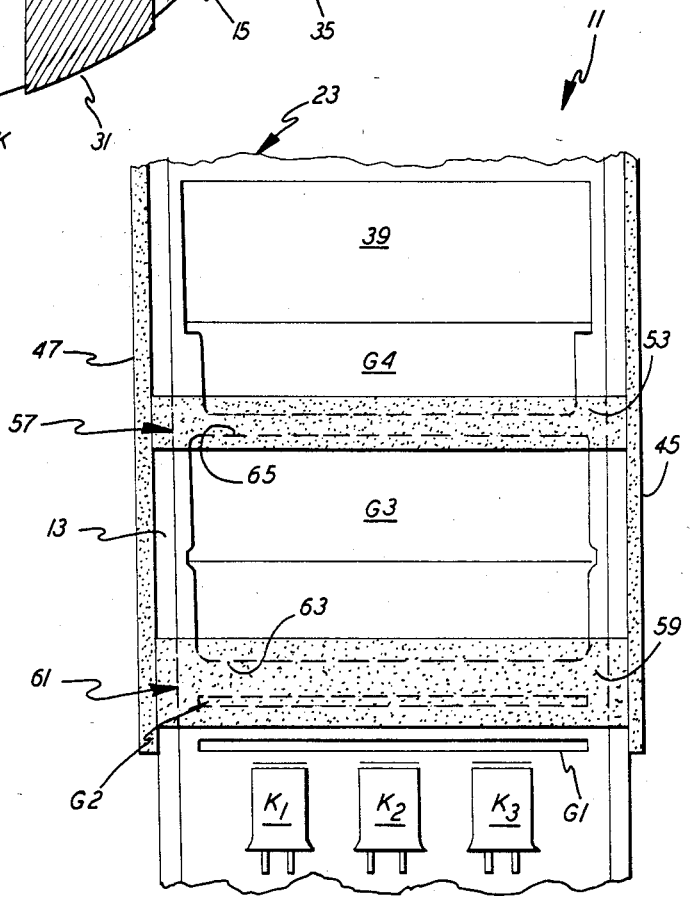
FIGS. 4 and 5 are views of the neck portions of tubes showing the relationship of the invention to exemplary bi-potential and tri-potential in-line electron gun assemblies.
Figure 5:
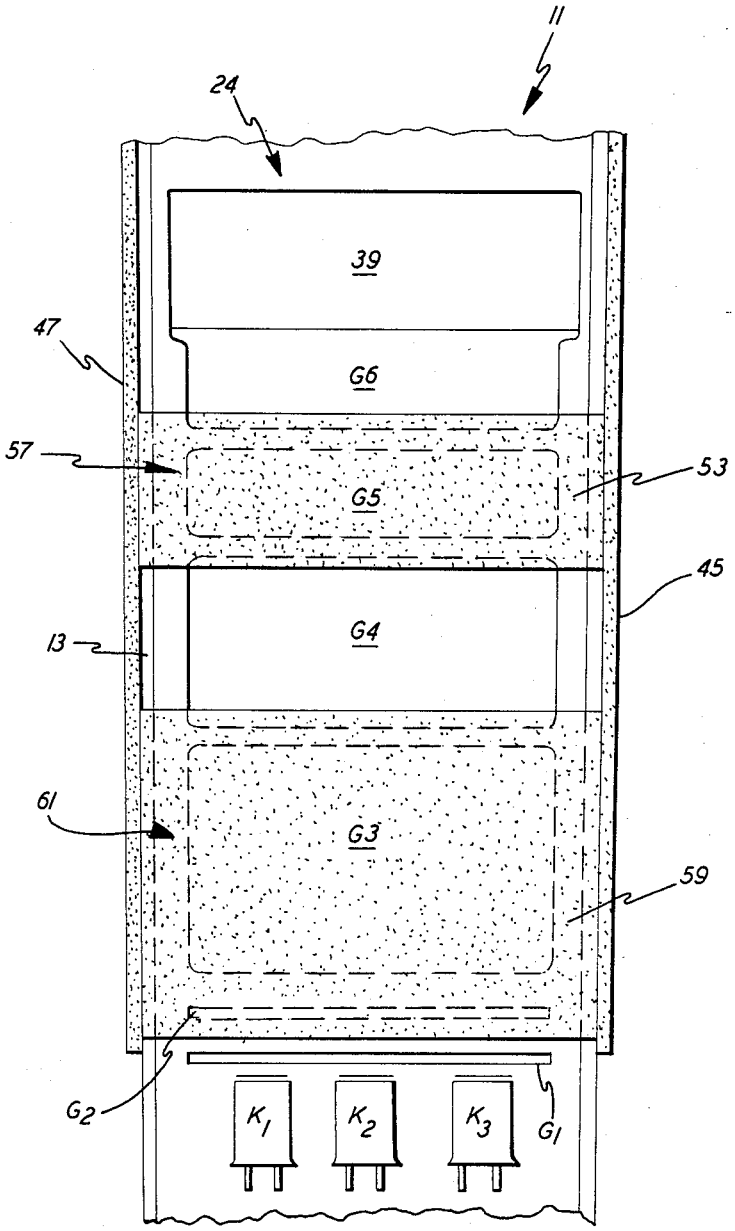

In other embodiments of the invention, the exterior electrically conductive stripes 45 and 47 are joined by a first pair of opposed arc-like strips 53 and 55 (both are shown in FIG. 2, 53 only is shown in FIGS. 4 and 5) of conductive material applied externally on the neck portion 13 to form a first substantially peripheral band-like layer 57 of conductive material over the inter-electrode spacing between the final focusing and accelerating electrodes of the gun assembly 23. Spaced from the first band, the stripes 45 and 47 are further joined by a second pair of opposed arc-like strips of conductive material, of which only 59 is shown in FIGS. 4 and 5, to form a second substantially peripheral band-like layer 61 of conductive material over the inter-electrode spacing between the beam forming and initial accelerating electrodes of the gun assembly.

Figure 3:
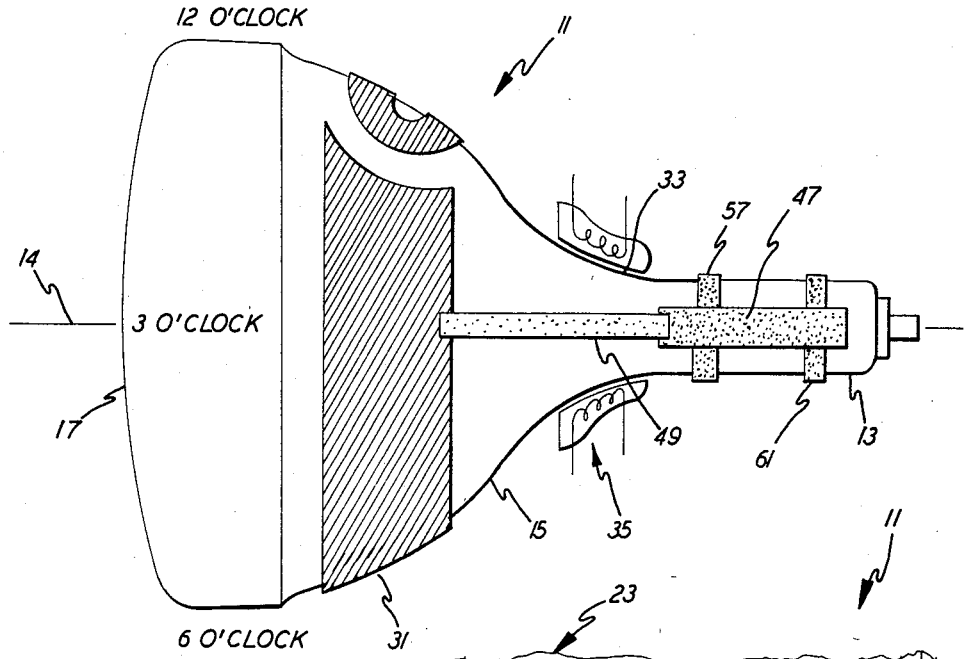
FIG. 3 is a side view of the tube taken along the plane 3—3 of FIG. 2.

In the presently most preferred embodiment, shown in FIG. 3, conductive layers 57 and 61, connected by conductive stripes 47 and 45 (not shown), are connected to the ground layer 31 by a single connective strip 49. This strip 49 is oriented on the tube surface to be located under the low voltage side of the deflection yoke 35. This corresponds to the three o'clock side of the tube, located by assigning positions similar to those on the face of an analog clock to the exterior sides of the tube, as shown in FIGS. 2 and 3.

In FIG. 4, the gun-related conductive means of the invention is applied to a unitized bi-potential electron gun assembly, wherein a plurality of unitized in-line apertured electrode members are sequentially positioned forward of individual cathode elements, $K_1$, $K_2$, $K_3$. The bi-potential electrode arrangement includes an initial beam forming electrode (G1), an initial beam accelerating electrode (G2), a main focusing electrode (G3) having a longitudinal dimension defined by rearward and forward apertured ends and a final accelerating electrode (G4). The first band-like conductive layer 57 is positioned to substantially encompass the (G3)-(G4) inter-electrode spacing, while the related second band-like conductive layer 61 is located to substantially encompass the (G3)-(G2) inter-electrode spacing.

In FIG. 5, the gun-related conductive means of the invention is applied to a unitized tri-potential in-line gun assembly, having a plurality of electrodes positioned forward of individual cathode elements $K_1$, $K_2$, $K_3$, including an initial beam forming electrode (G1), an initial beam accelerating electrode (G2), a first high focusing electrode (G3), a low focusing electrode (G4), a second high focusing electrode (G5) and a final accelerating electrode (G6). Each of the (G3), (G4) and (G5) electrodes has a longitudinal dimension defined by forward and rearward apertured ends. In this embodiment, the first band-like conductive layer 57 is positioned to substantially encompass the (G4)-(G5) and (G5)-(G6) inter-electrode spacings. The spatially related second band-like conductive layer 61 is oriented to substantially encompass the (G2)-(G3) and the (G3)-(G4) inter-electrode spacings.

The invention has been described in terms of a limited number of embodiments. Other embodiments will become apparent to those skilled in the art. For example, a single conductive stripe, either with or without one or more associated conductive bands, while less effective than the embodiments shown herein, would nevertheless significantly reduce neck charge build-up.

We claim:

1. An improvement in an in-line color cathode ray tube having an envelope formed of an intergration of a forwardly oriented viewing panel portion, an intermediate funnel portion, and a rearward neck portion, a cathodoluminescent screen of a plurality of phosphor elements disposed on the interior surface of the viewing panel, an aperture mask positioned adjacent the screen, an in-line plural beam electron gun assembly, said assembly embodying three electron-generating cathodes and a plurality of electrodes, including a beam forming electrode, an initial accelerating electrode, a final focusing electrode and a final accelerating electrode, each of said electrodes having a center and two side apertures, said gun assembly positioned in said neck portion in a manner to project said beams to pass through the mask and converge upon the screen, an external electrically conductive coating disposed on said funnel portion, and a deflection yoke oriented to surround the envelope at substantially the transition area between the funnel and neck portions, to provide magnetic fields for electron beam deflection, said improvement being external neck charge dissipation means comprising: at least one longitudinal stripe of conductive material disposed on the exterior surface of said neck portion over substantially the entire narrow side of the gun assembly; and electrical connective means joining said neck charge dissipation means with the external conductive coating; the electrical connective means comprising a single conductive strip located on the side of the tube corresponding to the low voltage side of the yoke, and having an electrical resistance of about $10^6$ to $10^{10}$ ohms/centimeter.

2. The improvement for an in-line color cathode ray tube according to claim 1 wherein said external neck charge dissipation means comprises two stripes, each of said stripes oppositely disposed over substantially one entire narrow side of the gun assembly, and each being joined to said funnel coating by separate connective means.

3. The improvement for an in-line color cathode ray tube according to claim 1 wherein the neck charge dissipation means additionally includes a first peripheral band-like layer of conductive material around the neck portion and integral with the stripe substantially over the inter-electrode spacing between the final focusing and accelerating electrodes of the gun assembly.

4. The improvement for an in-line color cathode ray tube according to claim 3 wherein the neck charge dissipation means additionally includes a second peripheral band-like layer of conductive material around the neck portion and integral with the stripe substantially over the inter-electrode spacing between the beam forming and initial accelerating electrodes of said gun assembly.

5. The improvement for an in-line color cathode ray tube according to claim 4 wherein said electron gun assembly is of bi-potential construction in which each gun has in sequence a cathode (K), an initial beam forming electrode (G1), an initial beam accelerator electrode (G2), a main focusing electrode (G3) having a longitudinal dimension defined by rearward and forward apertured ends, a final accelerator electrode (G4) and a convergence cup; and wherein said first band-like conductive layer is positioned substantially over the forward (G3)-(G4) inter-electrode spacing, and the related second band-like conductive layer is located substantially over the rearward (G3)-(G2) inter-electrode spacing.

6. The improvement for an in-line color cathode ray tube according to claim 4 wherein said electron gun assembly is of tri-potential construction in which each gun has in sequence a cathode (K), an initial beam forming electrode (G1), an initial beam accelerator electrode (G2), a first high focusing electrode (G3), a low focusing electrode (G4), a second high focusing electrode (G5), a final accelerator electrode (G6), and a convergence cup, each of said (G3), (G4) and (G5) electrodes having longitudinal dimensions defined by forward and rearward apertured ends; and wherein said first band-like conductive layer is oriented substantially over the forward (G4)-rearward (G5) and the forward (G5)-(G6) inter-electrode spacings, and said second band-like conductive layer is positioned substantially over the (G2)-rearward (G3) and the forward (G3)-rearward (G4) inter-electrode spacings of said gun assembly.

* * * * *